US011744371B2

(12) United States Patent
Wang et al.

(10) Patent No.: US 11,744,371 B2
(45) Date of Patent: Sep. 5, 2023

(54) CHAIR DEVICE AND STAR-SHAPED BASE THEREOF

(71) Applicant: HENGLIN HOME FURNISHINGS CO., LTD., Zhejiang (CN)

(72) Inventors: Jianglin Wang, Huzhou (CN); Zhengxing Wang, Huzhou (CN); Hermann Bock, Huzhou (CN)

(73) Assignee: HENGLIN HOME FURNISHINGS CO., LTD., Zhejiang (CN)

( * ) Notice: Subject to any disclaimer, the term of this patent is extended or adjusted under 35 U.S.C. 154(b) by 82 days.

(21) Appl. No.: 17/612,576

(22) PCT Filed: May 8, 2020

(86) PCT No.: PCT/CN2020/089197
§ 371 (c)(1),
(2) Date: Nov. 19, 2021

(87) PCT Pub. No.: WO2020/233417
PCT Pub. Date: Nov. 26, 2020

(65) Prior Publication Data

US 2023/0083858 A1 Mar. 16, 2023

(30) Foreign Application Priority Data

May 20, 2019 (DE) ..... 10 2019 113 235.5
May 7, 2020 (CN) ..... 202010378589.4

(51) Int. Cl.
*A47C 7/00* (2006.01)
*A47C 3/025* (2006.01)
*A47C 9/00* (2006.01)

(52) U.S. Cl.
CPC ..... *A47C 7/004* (2013.01); *A47C 3/025* (2013.01); *A47C 7/006* (2013.01); *A47C 9/002* (2013.01)

(58) Field of Classification Search
CPC ..... A47C 7/004; A47C 7/006
(Continued)

(56) References Cited

U.S. PATENT DOCUMENTS 4,053,129 A * 10/1977 Graff ..... A47C 7/006 248/188.7
4,699,344 A 10/1987 Vaughan
(Continued)

FOREIGN PATENT DOCUMENTS

| | | |
|---|---|---|
| CN | 205618929 | 10/2016 |
| DE | 102009007324 | 8/2010 |
| WO | 2008084113 | 7/2008 |

OTHER PUBLICATIONS

"International Search Report (Form PCT/ISA/210) of PCT/CN2020/089197," dated Jul. 29, 2020, with English translation thereof, pp. 1-4.

*Primary Examiner* — Rodney B White
(74) *Attorney, Agent, or Firm* — JCIPRNET

(57) ABSTRACT

Disclosed are a chair device and a star-shaped base (3) thereof, in particular capable of being used for office chairs, work chairs, stools or standing auxiliary devices, the star-shaped base comprising a center seat (4) and a plurality of extending arms (5) mounted on the center seat (4), wherein the extending arms (5) are used for the star-shaped base (3) to be placed on the ground, and at least one of the extending arms (5) is hinged to the center seat (4) and can rotate relative to the center seat (4). A chair seat of the chair device can rotate or swing, while parts mounted at an upper end of a chair column do not need to be modified, and particularly, a supporting structure, a chair support for the chair seat to be placed, and the chair seat itself do not need to be modified.

11 Claims, 3 Drawing Sheets

(58) Field of Classification Search
USPC ..... 248/129, 188.7, 346.11
See application file for complete search history.

(56) References Cited

U.S. PATENT DOCUMENTS

| | | | | |
|---|---|---|---|---|
| 5,505,524 | A | 4/1996 | Drumwright | |
| 8,020,938 | B2 * | 9/2011 | Glockl ..... | A47C 7/004 248/188.7 |

* cited by examiner

CHAIR DEVICE AND STAR-SHAPED BASE THEREOF

CROSS-REFERENCE TO RELATED APPLICATION

This application is a 371 of international application of PCT application serial no. PCT/CN2020/089197, filed on May 8, 2020, which claims the priority benefit of German patent application no. 10 2019 113 235.5, filed on May 20, 2019 and China patent application no. 202010378589.4, filed on May 7, 2020. The entirety of each of the above mentioned patent applications is hereby incorporated by reference herein and made a part of this specification.

TECHNICAL FIELD

The disclosure relates to a chair device and a star-shaped base thereof, and particularly to a base used for office chairs, work chairs, stools, or standing auxiliary equipment.

DESCRIPTION OF RELATED ART

Nowadays, for chair devices, especially office chairs, work chairs, and stools, star-shaped bases are the standard solution for the foundation. Usually, the chair device has a chair column, which may be adjusted in height. There is a supporting structure on the chair column for placing a seat surface. The supporting structure includes, for example, a foundation support, a chair support, and, if necessary, a backrest support. The star-shaped base is usually applied to a swivel chair, a swivel stool, or a chair. The seat surface of the devices may rotate around the longitudinal axis of the chair column.

Regardless of the existing movable and adjustable chairs, the so-called "movable chairs" are now vigorously promoted from an ergonomic point of view. The posture, such as the tilt, of such chair device may be changed along with the load on the chair device and/or changes in the load, especially when the user of the chair device sits at different positions of the chair device or when the center of gravity of the user changes due to movement. In this respect, the chair device is designed to be rotatable or swingable in all directions. For this reason, structural transformations are often performed on existing chair devices or supporting structures with good performance. However, the mechanical solution produced in this way is not only more complicated, but also requires high costs to manufacture. Generally speaking, due to the need to add necessary components and provide necessary space, changes in the design of the chair device or the supporting structure will become worse.

SUMMARY

Technical Problem

The objective of the disclosure is to provide a chair device that can rotate or swing without changing existing parts, especially a supporting structure of a chair seat or a seat surface, on top of a chair column of the chair device.

Technical Solution

The objective can be implemented through the star-shaped base and the chair device described in the independent claims of the disclosure. Preferred embodiments are provided in the dependent claims.

A core idea of the disclosure is to implement the rotation and the swing of a chair seat or a seat surface through modifying parts below the chair column of the chair device. As such, a movable star-shaped base is provided.

The star-shaped base of the disclosure is characterized in that among extending arms mounted on a center seat of the star-shaped base, at least one extending arm is hinged to the center seat and may rotate relative to the center seat. A chair of the disclosure is characterized in that the chair is provided with the star-shaped base.

According to a first aspect of the disclosure, the star-shaped base with the extending arms that may rotate relative to the center seat can implement changes in position of the center seat, which include lowering of the center seat in a vertical direction and tilting of the center seat relative to a horizontal plane, that is, tilting relative to the ground. Therefore, in the chair device, all parts arranged above the center seat and supported by the center seat and the chair column fixed on the center seat, including the supporting structure and the chair, may implement rotation or swing in addition to lowering movement without specially designing the supporting structure.

The extending arm mounted on the center seat of the star-shaped base is usually fixed with a roller. Through the roller, the chair device may move on the ground. Although the chair device may implement very safe and stable standing on the ground by means of the star-shaped base, the star-shaped base with rollers still has the following situations: the chair device may accidentally move or roll on the ground, even when the user is sitting on the chair device. Even though the rolling of the chair device is usually small, such accidental movement may still pose a danger. In other words, the user may fall or be injured due to such accidental rolling of the chair device or the user may be disturbed due to such movement of the chair device while sitting. When the user of the chair device is an elderly, the dangers are more prominent.

According to a second aspect of the disclosure, the solution of the disclosure can avoid the accidental rolling or the accidental movement of the chair device. The chair device here refers to the type in which the extending arm of the star-shaped base is provided with the roller. The solution is that when the seat surface of the chair device is loaded due to the user, the center seat of the star-shaped base may be lowered to the ground due to the rotatability of the extending arm. Since the user applies a force on the chair, a static friction generated by the force on the center seat can avoid the accidental rolling or the accidental movement of the chair. The static friction here is greater than a rolling friction required for rolling. Such simple method can provide a safe chair or stool, which is attractive to the elderly. At the same time, such chair may also be used applied to a workplace. In the workplace, the accidental movement of the chair interferes with work, but due to the need to move, the chair must be used.

In addition, from the technical point of view, chairs in the form of standing auxiliary devices are also more common. The standing auxiliary devices are rarely provided with the star-shaped base. The roller is rarely mounted on the foundation of the standing auxiliary device. On the standing auxiliary device, such "movable chair" is usually implemented by: mounting a joint close to the ground, so that the foundation supporting the seat surface may rotate.

According to a third aspect of the disclosure, the disclosure makes it possible to implement a new type of standing auxiliary device. In the auxiliary device, when the seat surface is fully loaded, the center seat of the star-shaped base is lowered to the ground to form a supporting point and a rotating point of the standing auxiliary device. Such state where the extending arm is firmly supported on the ground ensures that the standing auxiliary device is in a very safe state. At the same time, the extending arm with limited deflection also limits the rotation of the standing auxiliary device, thereby avoiding an undesirable extreme state of the standing auxiliary device, which may cause fall and injury.

Therefore, the disclosure may be used not only on office chairs, work chairs, and stools, but also on standing auxiliary devices.

In a preferred embodiment of the disclosure, each solution may contribute to the solution of the disclosure independently or in combination with each other. According to the preferred embodiment of the disclosure, each extending arm rotatable relative to the center seat:

a) is connected to the center seat. The extending arms may independently rotate without being affected by each other;

b) may rotate from an unrotated starting position to a maximum extent and may also be reset;

c) rotates relative to the center seat in such a way that: during an entire rotating process, a free end of the extending arm maintains a ground clearance.

and/or d) rotates relative to the center seat in such a way that: when the center seat is lowered, the extending arm maintains contact with the ground.

In addition, according to another preferred embodiment of the disclosure, the number of extending arms hinged to the center seat and rotating relative to the center seat is at least such that: when the extending arms simultaneously rotate, the center seat may be lowered to an extent of contacting the ground. Therefore, if the force of the load on the chair device is ensured to be sufficiently large, the center seat may be lowered to the ground, and the chair device may be used as the standing auxiliary device.

According to a preferred embodiment of the disclosure, a bottom surface of the center seat, that is, a surface of the center seat facing the ground, is manufactured into a convex surface. A convex supporting surface is preferably a spherical surface. Such spherical surface support enables the center seat lowered on the ground to easily implement the required rotation and swing.

According to a particularly preferred embodiment of the disclosure, all of the extending arms are hinged to the center seat and may rotate relative to the center seat. According to the preferred embodiment of the disclosure, the number of extending arms may be 4 or 6, but preferably 5.

According to a preferred embodiment of the disclosure, each extending arm that rotates relative to the center seat resists an elastic force of an elastic element when rotating.

According to a preferred embodiment of the disclosure, each extending arm that rotates relative to the center seat is provided with the elastic element. The elastic element acts between the extending arm and the center seat, that is, one end of the elastic element acts on the extending arm and the other end acts on the center seat. In simple cases, the elastic element may be a compression spring or an elastic block designed according to geometric conditions and made of an elastic material.

As such, an independent elastic element, such as a circular elastic block, may also be configured. Such elastic element may be easily mounted around the center seat.

When using the elastic element, due to an elastic action thereof, the chair device generates useful rotation and swing, and erect or reset behavior. If there is a load on the chair device, such as the user sitting on the chair device, the elastic action will provide a limiting resistance. The user of the chair device must resist the elastic force under the action of the load to move the chair device. Once the load on the chair device changes, such as due to the movement of the user on the seat surface or changes in position of the center of gravity of the user, the elastic action will provide a limiting rotational resistance. The user of the chair device must resist the elastic force when rotating or swinging in order to move the chair device. At the same time, according to the increase or decrease of the applied force, a corresponding elastic action is generated. The elastic force for support may restore the movement of the center seat to the starting position. If the load on the chair device completely disappears, that is, the chair device is unloaded, such as due to the user standing up, the center seat of the star-shaped base and the seat surface will automatically restore to an upright position.

According to a preferred embodiment of the disclosure, the roller is preferably mounted at the free end of the extending arm. By means of the rollers, the star-shaped base may move. A substitute of the roller may be a sliding part or other similar parts.

According to a preferred embodiment of the disclosure, the rotation of a single or all extending arms, or the lowering and tilting functions of the center seat may all be locked by means of a locking device. The locking device is preferably designed such that: a locking action is used to simultaneously lock the rotation of all of the extending arms from the starting position of the extending arm. Therefore, the star-shaped base assembled according to the disclosure may be used as a conventional non-movable base according to requirements.

According to a preferred embodiment of the disclosure, the locking occurs through a mechanical way. The preferred way is to at least partially fill a rotation space necessary for the rotation of the extending arm through the movement of a suitable locking element, and then perform mechanical locking, or lock an inward rotation of the extending arm in the rotation space through other ways.

BRIEF DESCRIPTION OF DRAWINGS

The embodiments of the disclosure can be better explained by means of the following drawings.

All the drawings are not intended to show the disclosure to scale, but are schematic views and only contain basic components. The same reference numerals represent the same elements or elements with similar functions.

REFERENCE SIGNS

Figure 1:
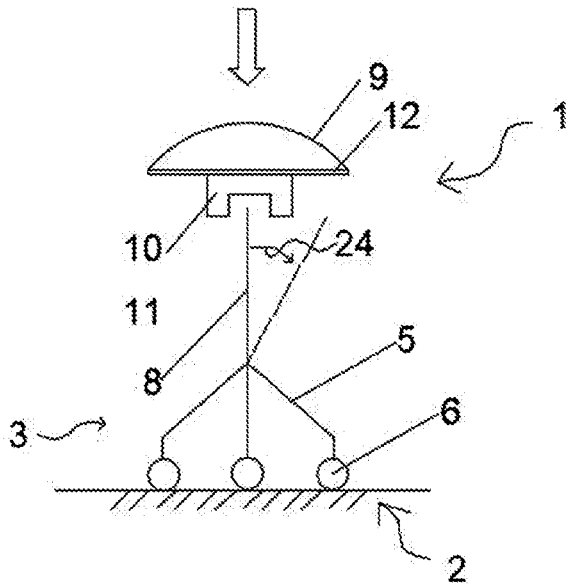
FIG. 1 is a chair device with a star-shaped base.

1. chair device, stool
2. ground
3. star-shaped base
4. center seat
5. extending arm
6. roller
7. accommodating sleeve
8. chair column 9. seat surface
10. foundation support
11. conical accommodating member
12. chair support
13. longitudinal axis of chair column
14. rotation axis
15. supporting surface
16. stopper block
17. grindable supporting surface, bottom surface of center seat
18. elastic element, compression spring
19. rotation space
20. free spacing
21. locking element
22. back surface of extending arm
23. lowering direction
24. rotation and swing direction
25. guide groove
26. guide pin
27. vertical direction
28. deflection direction

DETAILED DESCRIPTION OF DISCLOSED EMBODIMENTS

A chair device of the disclosure may be any one of an office chair, a work chair, a stool, or a standing auxiliary equipment. In the embodiment, a stool is used as an example for description. A stool 1 stands on a ground 2 through a foundation thereof. The foundation is designed as a star-shaped base 3. The star-shaped base 3 includes a center seat 4 (also referred to as a "hub") and five extending arms 5 mounted on the center seat. The extending arms are uniformly distributed along the center seat. A roller 6 is fixed to a free end of the extending arm 5. There is an accommodating sleeve 7 for a chair column 8 in the middle of the center seat 4. The height of the chair column 8 may be adjusted by means of a gas spring (not shown in the drawings).

There is a supporting structure for placing a seat surface 9 on the chair column 8. In the simple example shown here, the supporting structure includes a foundation support 10 and a chair support 12. The foundation support 10 and a conical accommodating member 11 are placed on the chair column 8. The chair support 12 is connected to the foundation support 10. There is the final seat surface 9 with a cushion on the chair support 12. The chair support 12 and the seat surface 9 are rotatable around a rotation axis of a longitudinal axis 13 of the chair column.

Figure 2:
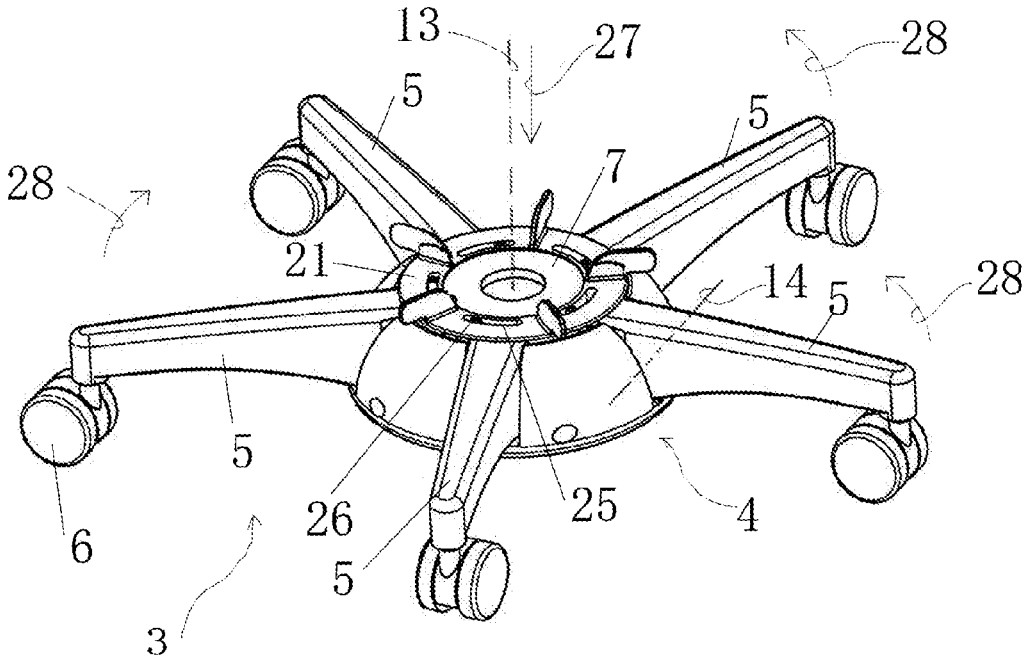
FIG. 2 is a perspective view of a star-shaped base.

All of the five extending arms 5 mounted on the center seat respectively have rotary joints that are hinged to the center seat 4 and rotate relative to the center seat 4. A rotation axis 14 shown in FIG. 2 is illustrative of direction and is parallel to a supporting surface 15 of the roller 6.

Figure 5:
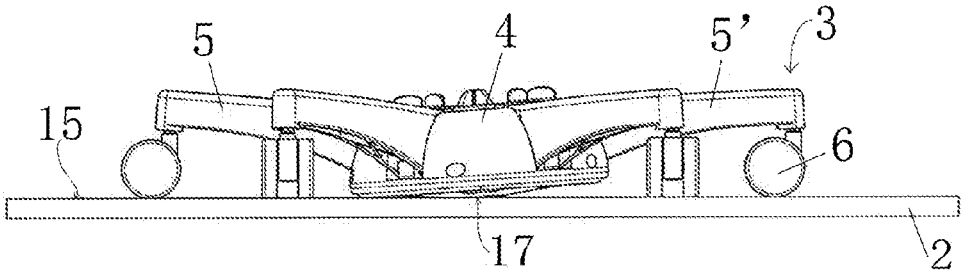
FIG. 5 is a side view of a non-uniformly loaded star-shaped base.
Figure 6:
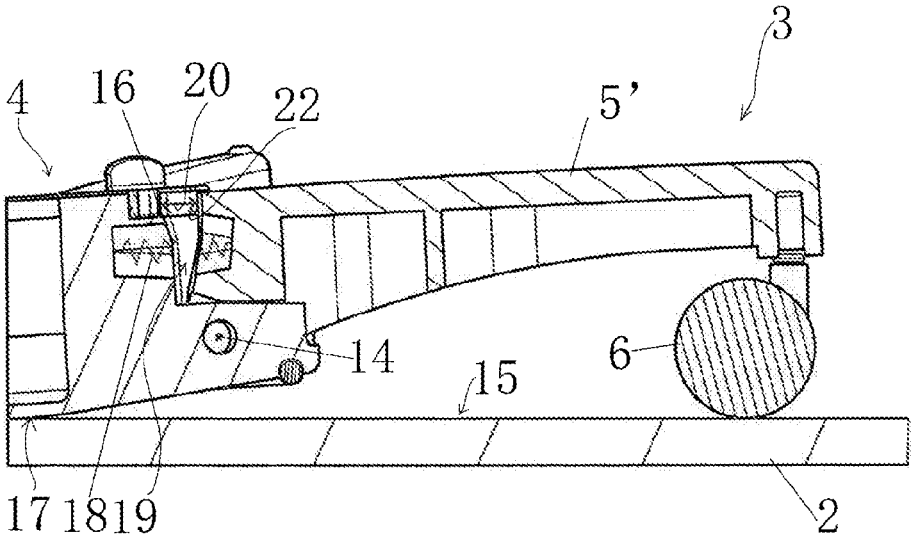
FIG. 6 is a detailed cross-sectional view of the side view of FIG. 5.

Each extending arm 5 is independently connected to the center seat 4 and rotates without being affected by the other extending arms 5. The extending arm 5 may rotate from an unrotated starting position shown in FIG. 3 and FIG. 4 to a maximum deflection position shown in FIG. 5 and may restore the rotation. As shown in FIG. 6, a maximum rotation position and a degree of deflection of the extending arm 5 are determined by a stopper block 16 on the center seat 4.

The feature of the structure is that the extending arm 5 is stably placed on the supporting surface 15, that is, supported on the ground 2, which does not depend on whether the seat surface 9 is loaded or whether the center seat 4 is lowered and/or tilted. In other words, the extending arm 5 rotates relative to the center seat 4 in such a way that: during an entire rotating process, the free end of the extending arm 5 maintains a ground clearance. The free end maintains contact with the ground through the roller 6 or similar components. The structure is designed such that when the center seat 4 is lowered, the contact between the extending arm 5 and the ground may be maintained while the extending arm 5 rotates relative to the center seat 4. Depending on the degree of deflection of each extending arm 5, the center seat 4 may be lowered, even to an extent of contacting the ground 2.

A bottom surface of the center seat facing the ground 2 is made into a convex surface to form an arch-shaped grindable supporting surface 17. When the center seat 4 contacts the ground, the center seat 4 may grind along the supporting surface. In this way, in a completely lowered state, the chair device may rotate or swing.

When the extending arm 5 rotates relative to the center seat 4, the extending arm 5 needs to resist an elastic force of an elastic element. Each extending arm 5 is provided with an elastic element. In FIG. 6, an elastic element 18 of the extending arm 5 is only symbolically represented as a compression spring. The placement of the elastic element enables the elastic element to work between one end of the extending arm 5 and the other end of the center seat 4. Once the load on the extending arm 5 disappears or decreases, the elastic element 18 may pull the extending arm 5 from a rotation position back to the starting position.

By means of an annular locking element 21 mounted on the center seat 4, the rotation of all of the extending arms 5 may be simultaneously locked. The locking element may rotate around the rotation axis in a direction of the longitudinal axis 13 of the chair column relative to a center seat base from a middle position (see FIG. 6) to a locked position. A braking element (not shown in the drawings) mounted on the locking element 21 is guided to a back surface 22 of the extending arm 5. The back surface faces the center seat 4. The main thing is that a rotation space 19 is simultaneously embedded. A mechanical connection that transmits force is formed at least in an immediate area between the back surface 22 and the stopper block 16. As a result, the movement of the extending arm 5 rotating to the rotation space 19 and the rotation of the extending arm 5 are blocked. There is an arc-shaped guide groove 25 on the locking element 21 close to the center seat 4, and a guide pin 26 mounted on the center seat base is embedded therein. In the rotation space 19, the extending arm 5 may rotate relative to the center seat 4. The rotation space 19 provides a free spacing 20. One side of the spacing is the back surface 22 of the extending arm 5, and the other side is the stopper block 16 mounted inside the center seat. The spacing determines a maximum degree of deflection.

Figure 3:
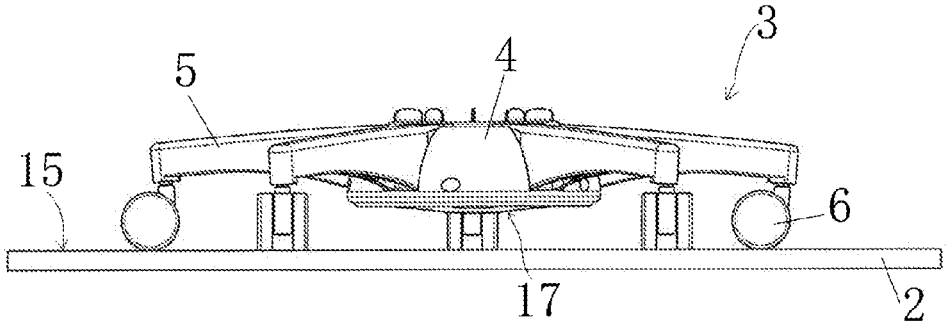
FIG. 3 is a side view of an unloaded star-shaped base.

FIG. 3 shows the star-shaped base 3 of the stool 1 when the seat surface 9 is not loaded. The rollers 6 are all on the ground. The grindable supporting surface 17 on the bottom surface of the center seat is spaced from the ground 2. The spacing between the lowest point of the bottom surface of the center seat and the ground 2 is preferably only a few centimeters.

Figure 4:
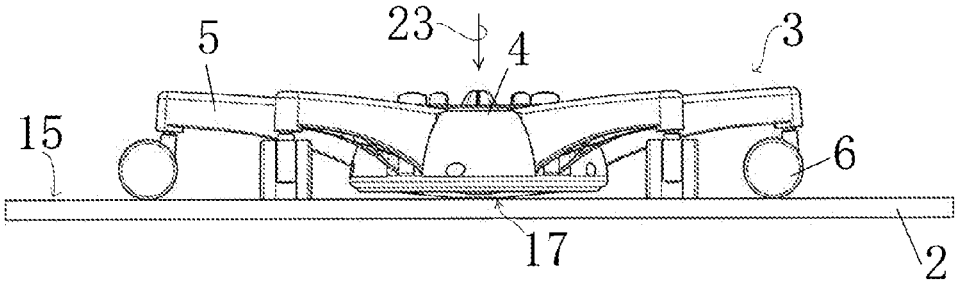
FIG. 4 is a side view of a uniformly loaded star-shaped base.

When the seat surface 9 is uniformly loaded, the center seat 4 moves along a vertical direction without tilting toward a horizontal direction. When the force of the load on the seat surface is sufficiently large, the center seat 4 is vertically lowered to the ground 2 along a lowering direction 23, as shown in FIG. 4. At the same time, all of the extending arms 5 will be deflected upward along a deflection direction 28 in the same way, especially the same route. The rollers 6 are always supported on the ground 2.

When the user not only causes the seat surface 9 to move down, but also to rotate or swing, the rolling of the stool 1 is avoided due to a friction effect of the spherical bottom surface of the center seat when grinding. The extending arm 5 plays a role of further support to ensure that the stool 1 safely stands.

When the position of the center of gravity of the user changes, the seat surface 9 bears a non-uniform load and may rotate or swing (as shown by an arrow 24 in FIG. 1). The center seat 4, which is still on the ground 2, will be tilted relative to the vertical direction (as shown in FIG. 5 and FIG. 6). According to a tilting direction, some extending arms 5 will rotate more, while other extending arms 5 will rotate less. When the center seat 4 not yet contacts the ground, such tilting of the center seat 4 may also occur. When the seat surface 9 is non-uniformly loaded or the deflection or the swing relative to the vertical direction is very strong, the extending arm 5 may be further deflected upward. Nevertheless, the roller 6 still maintains contact with the ground, that is, the roller 6 will always be on the ground and become an additional supporting surface. According to an action direction of the force of the load exerted by the user on the stool 1 and taking into account a restoring force provided by the elastic element 18, the center seat 4 will be tilted to different degrees in different spatial directions, which means that the extending arm 5 mounted on the center seat 4 will deflect with different intensities. FIG. 5 shows a case where the center seat is lowered and tilted. FIG. 6 is a cross-sectional view when the extending arm is in the middle position with less rotation in the case.

The lowering and the tilting of the center seat 4 may be simultaneously performed. If the center seat 4 is lowered to the ground, the center seat 4 may still be further tilted.

The lowering movement and the tilting movement of the center seat 4 and the rotation and the swing of the seat surface 9 are limited through the elastic force of the elastic element 18 mounted on the extending arm 5. A lowering path of the center seat 4 or a rotating path of the extending arm 5 and a restoring braking force of each elastic element 18 that participates due to the movement of the center seat 4 show a linear relationship. At the same time, the tilting movement of the center seat 4 and the rotation and the swing of the seat surface 9 may be limited, which may be implemented through setting a maximum deflection of the extending arm 5. When the extending arm 5 reaches the maximum deflection, the extending arm 5 abuts the stopper block 16 provided on the center seat 4. The stopping of the lowering movement is not implemented through the extending arm 5 contacting the center seat 4, but through the center seat 4 being lowered to the ground 2.

The disclosure relates to the star-shaped base on the chair device, which may be used in office chairs, work chairs, stools, or standing auxiliary devices in particular. In order to provide the chair device 1: the seat surface 9 may rotate or swing without changing the parts, especially the supporting structure 10, the chair support 12 where the seat surface 9 is mounted, the seat surface. The rotation or the swing of the seat surface 9 may be achieved by: modifying the parts of the chair device 1 mounted below the chair column 8, that is, mounting the movable star-shaped base 3. The star-shaped base 3 is characterized in that at least one of the extending arms 5 mounted on the center seat 4 is hinged to the center seat 4 and may rotate relative to the center seat 4.

In other embodiments, the center seat has multiple extensions respectively extending outward. The extensions are disposed in a one-to-one correspondence with the extending arms. At least one or all of the extending arms are respectively hinged to the corresponding extensions on the center seat. An elastic element is disposed between the extending arm and the corresponding extension. The elastic element provides the elastic force resisting the rotation of the extending arm relative to the center seat. Other structures are disposed with reference to the above embodiment.

In other embodiments, in addition to being hinged to the center seat, at least one or all of the extending arms are also connected to the center seat through a connecting rod, so that a crank slider mechanism is formed between the extending arm, the connecting rod, and the center seat. One end of the connecting rod is hinged to the center seat, and the other end of the connecting rod is slidably connected to the extending arm. Alternatively, one end of the connecting rod is hinged to the extending arm, and the other end of the connecting rod is slidably connected to the center seat. In addition, an elastic element (preferably a compression spring or a tension spring) is disposed between any two of the connecting rod, the extending arm, and the center seat. The elastic element provides the elastic force resisting the rotation of the extending arm relative to the center seat. Other structures are disposed with reference to the above embodiment.

In other embodiments, in addition to being hinged to the center seat, at least one or all of the extending arms are also connected to the center seat through two connecting rods, so that a planar four-bar mechanism is formed between the extending arm, the two connecting rods, and the center seat. An elastic element (preferably a compression spring or a tension spring) is disposed between any two of the extending arm, the two connecting rods, and the center seat. The elastic element provides the elastic force resisting the rotation of the extending arm relative to the center seat. Other structures are disposed with reference to the above embodiment.

In the various embodiments above, the number of extending arms of the star-shaped base may be 3, 4, 5, 6, or more than 6, but preferably 5.

All the features described in the specification, appended claims, and drawings, either independent or in any combination thereof, are important features of the disclosure.

In the description of the specification, description with reference to terms such as "an embodiment", "some embodiments", "an implementation", "a specific implementation", "other implementations", "examples", "specific examples", or "some examples" means that the specific features, structures, materials, or characteristics described in conjunction with the embodiments or the examples are included in at least one embodiment, implementation, or example of the disclosure. In the specification, the schematic representations of the above terms do not necessarily refer to the same embodiment or example. Moreover, the specific features, structures, materials, or characteristics described above may also be combined in any one or more embodiments, implementations, or examples in a suitable manner. The technical solution recited in the disclosure also includes any one or more of the specific features, structures, materials, or characteristics described above independently or in combination.

Although the embodiments of the disclosure have been shown and described above, it can be understood that the above embodiments are exemplary and should not be construed as limiting the disclosure. Persons skilled in the art may change, modify, replace, transform, delete some features, add features, or recombine features within the scope of the disclosure without departing from the principle and objective of the disclosure. Any simple modification, equivalent changes, and revisions made to the above embodiments according to the innovative principle of the disclosure still fall within the scope of the technical solution of the disclosure.

What is claimed is:

1. A star-shaped base for a chair device, comprising a center seat and a plurality of extending arms mounted on the center seat, the extending arms being used to place the star-shaped base on a ground, wherein: at least one of the extending arms is hinged to the center seat and rotates relative to the center seat, wherein: rotation of one or all of the extending arms is locked by a locking element; and the locking element is an annular locking element mounted on the center seat, rotation of all of the extending arms are simultaneously locked; when the locking element rotates around a longitudinal axis direction of a chair column relative to the center seat to a locked position, a braking element on the locking element is embedded between the center seat and the extending arms, thereby blocking the rotation of the extending arms relative to the center seat.

2. The star-shaped base according to claim 1, wherein: each of the extending arms rotatable relative to the center seat is independently and rotatably connected onto the center seat without being affected by other extending arms.

3. The star-shaped base according to claim 1, wherein:

each of the extending arms rotatable relative to the center seat can rotate from a starting position to a maximum rotatable position and be restored;

each of the extending arms rotatable relative to the center seat rotates relative to the center seat in such a way that: during an entire rotating process, free ends of the extending arms maintain ground clearance;

each of the extending arms rotatable relative to the center seat rotates relative to the center seat in such a way that: when the center seat is lowered, the extending arms maintain contact with the ground; and at least a plurality of the extending arms are hinged on the center seat and are rotatable relative to the center seat, so that when the extending arms simultaneously rotate, the center seat is lowered to an extent of contacting the ground.

4. The star-shaped base according to claim 1, wherein: all of the extending arms are hinged to the center seat and are rotatable relative to the center seat.

5. The star-shaped base according to claim 1, wherein: five of the extending arms are all mounted on the center seat.

6. The star-shaped base according to claim 1, wherein: a bottom surface of the center seat is made into a convex shape.

7. The star-shaped base according to claim 1, wherein: a free end of the extending arm is fixed with a roller.

8. The star-shaped base according to claim 1, wherein: each of the extending arms rotatable relative to the center seat needs to resist an elastic force of an elastic element when rotating.

9. The star-shaped base according to claim 8, wherein: a first end of the elastic element acts on the extending arm, and a second end of the elastic element acts on the center seat.

10. The star-shaped base according to claim 9, wherein the elastic element is a compression spring.

11. The star-shaped base according to claim 1, wherein: the locking element is provided with an arc-shaped guide groove, and a guide pin mounted on the center seat is embedded in the guide groove.

* * * * *